US005368083A

United States Patent [19]

Beck, III

[11] Patent Number: 5,368,083

[45] Date of Patent: Nov. 29, 1994

[54] TELESCOPIC KELLY BAR APPARATUS AND METHOD

[76] Inventor: August H. Beck, III, 10 Heathwood, San Antonio, Tex. 78248

[21] Appl. No.: 936,025

[22] Filed: Aug. 26, 1992

[51] Int. Cl.[5] ..... E21B 3/04; E21B 17/07

[52] U.S. Cl. ..... 175/57; 175/195

[58] Field of Search ..... 175/57, 321, 322, 202, 175/195, 173

[56] References Cited

U.S. PATENT DOCUMENTS

| | | | |
|---|---|---|---|
| 1,895,901 | 1/1933 | Smith | 175/321 X |
| 3,194,330 | 7/1965 | Ware et al. | 175/321 |
| 3,255,612 | 6/1966 | Mayer et al. | 175/321 X |
| 3,354,950 | 11/1967 | Hyde | 175/321 X |
| 3,957,125 | 5/1976 | Russell, Jr. | 175/321 X |
| 5,168,944 | 12/1992 | Andersson | 175/321 |
| 5,184,688 | 2/1993 | Trevisnani | 175/321 |

*Primary Examiner*—Stephen J. Novosad
*Attorney, Agent, or Firm*—Charles W. Hanor

[57] ABSTRACT

A telescopic kelly bar assembly for use in drilling large excavations. The kelly assembly consists of a lower outer bar section, at least one middle bar sections and an upper inner bar section. Each bar has its own driver that either rests on top of the next size larger bar or is engaged to the rotary. The driver that is engaged on the rotary depends on which bar is the extended bar in the shaft excavation, since the driver that is engaged to the rotary is the driver of the bar that is extended in the shaft. The entire assembly is suspended by a swivel attached to a multi-part traveling block. When a bar is driven it is either driven by its driver via the rotary or by the next size smaller bar within the rotary. Lugs are added on the inside of the outer and middle bars at the top. If a round cross-section is used, the inside lugs transmit torque when fully extended from one bar to another. A thick ring is welded to the bottom of the middle bar and upper inner bar. The inside lugs and the bottom rings also act as stops to hold the bars together when hanging extended. Slots or holes located near the tops of the bars are used to receive pins. These slots and pins can hold all or some of the bars together. They also are used to hang the bars from the rotary. The bars can also be extended by removing the pins.

5 Claims, 13 Drawing Sheets

TELESCOPIC KELLY BAR APPARATUS AND METHOD

FIELD OF THE INVENTION

This invention relates to the apparatus for large diameter shaft drilled excavations. More particularly, it relates to the use of kelly bars for large diameter shaft drill excavations. Specifically, it relates to the use of a reverse telescopic kelly bar for large diameter shaft excavations.

BACKGROUND OF THE INVENTION

In the drill shaft industry, kelly bars are used to transmit the twisting torque from the rotary machinery to the bit or drill tool. This gives the bit or drill tool the ability to turn and excavate the earthen materials directly below itself.

The outside cross-section of a kelly bar is usually square, although other shaped kellys are sometimes used, such as round or hexagonal. The purpose of the cross-section is to enable torque to be transmitted from the rotary table to the cutting bit. During drilling operations, the kelly bushings or drivers remain on the rotary. Torque is applied from the rotary table through the kelly bushing, and thence to the kelly bar itself. The kelly bar is free to slide through the kelly bushing so that the drill can be rotated and simultaneously lowered or raised during drilling operations.

The drill shaft industry is normally associated with shaft excavations that range from 12 inch diameter to 10 feet or more diameter shafts. Depths range from several feet to 100′ or more. The bigger the diameter and greater the depth the bigger drill rigs and the larger kelly bars need to be.

The kelly bar is usually raised and lowered by a single line usually made of braided wire rope or steel cable. This line is used to lower the kelly bar with the tool attached into the shaft and to raise the kelly bar and tool with excavated materials to the surface. A single line is usually adequate on depths up to 100 feet. When the shaft diameters are very large, which requires large, heavy drilling tools, and the kelly bar with the spoil exceed single line pull limits then multiple lines can be used.

A variation of a single kelly bar is the telescopic kelly bar. Telescopic kelly bars are used in the industry to achieve greater depths in drilling. It may comprise two sections, one inside the other. The outer bar may be made of square tubing and the upper inner bar may be made of solid square or possibly hollow square tubing. A single line hoist cable may be connected to the upper inner kelly bar by a swivel. The outer large kelly bar rests on the inner smaller kelly bar and drives the inner kelly bar. The smaller inner kelly bar is attached to the excavation tool such as an auger. As the auger proceeds deeper in the excavation, both kelly bars are extended downward until the top of the outer larger kelly bar descends to the top of the drive rollers or drive bushings. At the moment the top of the outer kelly bar hits the top of the drive rollers, the inner kelly bar will telescope or extend further downward from the outer bar. As the excavation progresses with each trip into the hole the telescoping of the kelly bar extends the auger to the bottom of the excavation until you reach the limit of the extension of the kelly bar.

Triple section bars and other multiple section bars are known. However, the middle bars are usually floating and the drill rig operator has little control over them. When these intermediate sections stick and no longer slidably telescope relative to the other sections, they may slide upwardly and possibly fall or slide down and cause damage.

Another configuration on telescopic kelly bars is to hold the upper outside bar with one hoist line and the lower inner bar with a separate hoist line. The drill operator coordinates the hoisting and lowering of the bars.

As the size and weight of structures increase, larger shafts are required. Large shafts for tunnels or mines have been excavated using mining techniques. It may be hard to drill the larger shafts due to the limitations of the currently available equipment. Two factors that make the use of traditional drill shaft techniques for very large and deep excavations difficult are torque requirements and hoisting requirements. Where a typical drill shaft is less than 10 feet in diameter, tunnel shafts may go up to 30 feet in diameter and a depth greater than 200 feet. These larger dimensions call for larger and longer kelly bars so they can transmit the required torque to extended depths. Larger dimensions call for longer and heavier kelly bars. The use of these larger kelly bars means that single line pulls on cranes may not be adequate. The weight of a large kelly bar that transmits high torque to great depths can be greater than 30,000 lbs. If we add to this the weight of the tool and the muck or the spoil being lifted from the excavation, a total weight greater than 50,000 lbs. may be handled by the crane and cable supporting the kelly bar and tool. In order to handle the increased loads, a multiple part line may be implemented. The use of a multiple part line on a deep shaft would be impractical on a conventional telescoping kelly bar. A reason for this is that the shieve block connected to the upper inner kelly might not be able to extend and descend through the outer kelly bar unless the outer kelly bar has an extremely large bore or inside cross-section.

The present invention includes a reverse telescopic multi-section kelly bar capable of digging hundreds of feet deep necessary for the large diameters associated with tunneling or other large diameter deep shaft requirements. An objective of the present invention is to solve some of the problems associated with drilling large diameter deep shafts. The lower outer bar of the present invention is rigid and is attached to the drill tool, a straight hole may be drilled when a drill tool is used that is slightly larger in diameter than the largest cross-section of the lower outer bar. This could not be accomplished with a conventional telescopic kelly bar because the tool attaches to the smaller bar. Once the lower outer bar on a conventional telescopic kelly bar is fully extended it can no longer follow the drill tool, thus losing the lower outer bar rigidly at the top of the tool and losing an excavation that is slightly bigger than the longest cross-section of the kelly bar attached to the tool. Another objective of this invention is to allow drilling near perfect straight shafts. Another objective of this invention is to provide the operator full control of the kelly bars. An additional objective of this invention is the elimination of uncontrolled floating of kelly bars. Another objective of this invention is to allow handling of large muck quantities. These and other objects of the invention will be apparent to those skilled in this art from the following detailed description of a preferred embodiment of the invention.

SUMMARY OF THE INVENTION

The invention comprises a reverse telescopic kelly bar that includes an outer bar, any number of middle bars, and an upper inner bar. Each section has its own driver that either rests on top of the adjacent, lower larger diameter section or is engaged to the rotary. The entire assembly is suspended by a swivel attached to a multi-shieve traveling block. When a section is rotated, it is either rotated by its driver via the rotary or by the connected and adjacent lower and smaller diameter section. Upper inner lugs are provided on the inside of the hollow sections. These upper inner lugs are located near the upper part of the middle bar and lower outer sections so that they can receive torque, if required by the cross-section, when fully extended from one section to another section below the rotary. A thick ring is welded to the bottom of the middle section and upper inner section. The inside lugs and the bottom ring also act as a stop to hold the adjacent sections together when they are fully extended so that adjacent sections can be supported from the other. Depending on the cross-sectional shape, the sections also may have outside drive lugs to transmit torque from the rotary and to transmit torque to the upper inner lugs of the next larger bar. The sections may have slots (or holes) and pins to connect each bar together and support the hanging sections. Square sections or other multi-sided sections may not need upper inner or outer lugs for purposes of transmitting or receiving torque. A lug would be needed for hanging the bar on the heavy ring.

BRIEF DESCRIPTION OF THE DRAWINGS

The invention will be further described in connection with the accompanying drawings, in which.

DESCRIPTION OF THE PREFERRED EMBODIMENT

Figure 1:
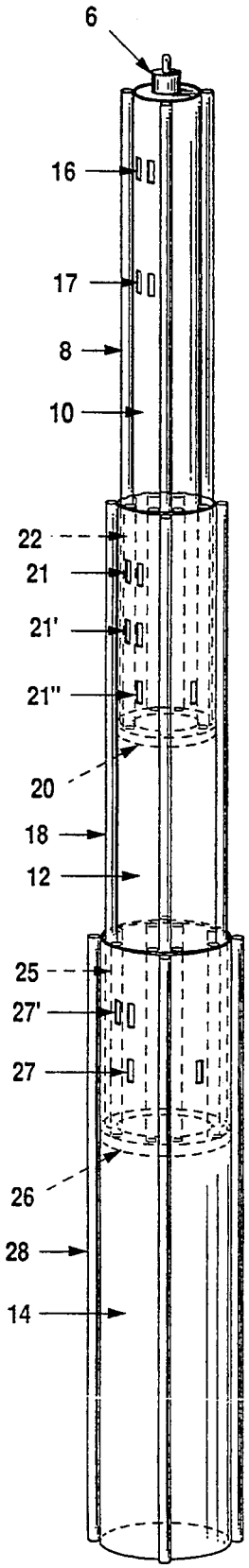
FIG. 1 is a perspective view of a three section kelly bar.
Figure 4A:
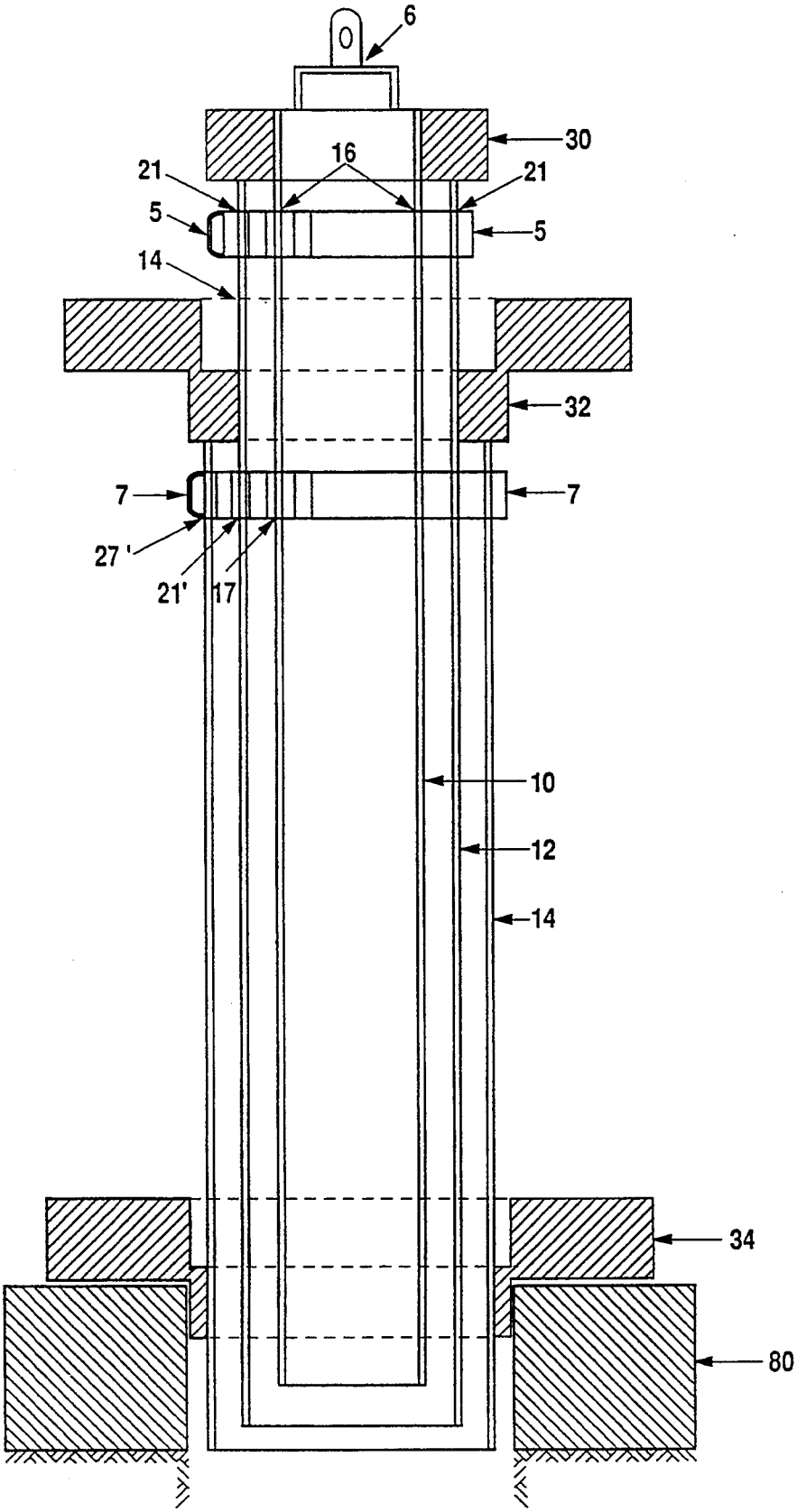
FIG. 4*a* is a cross-sectional view of the telescopic kelly bar positioned to begin to drill.

The present invention allows a drill operator to have visual contact to observe any section when necessary. It uses a reverse telescoping kelly bar as shown in FIGS. 1 and 4*a*. The reverse telescopic kelly bar assembly consists of an upper inner section 10, upper inner driver 30, middle section 12, middle driver 32, outer driver 34, lower outer section 14 and pins 5 and 7. Although three sections are shown, additional middle sections can be used. FIG. 1 shows the bar assembly configuration of the reverse telescopic kelly bar. Upper inner section 10 is comprised of outer drive lugs 8. Outer drive lugs 8 are designed to transmit torque to upper inner drive lugs 22 of middle section 12. An enlarged broken view of this is shown in FIG. 1*a*.

Figure 1A:
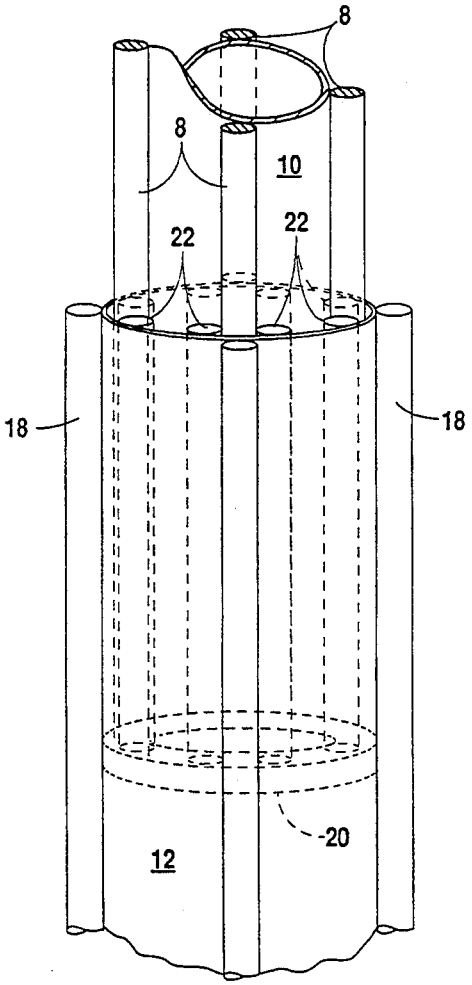
FIG. 1*a* is an enlargement of the joint between the two upper sections of the kelly bar.
Figure 1B:
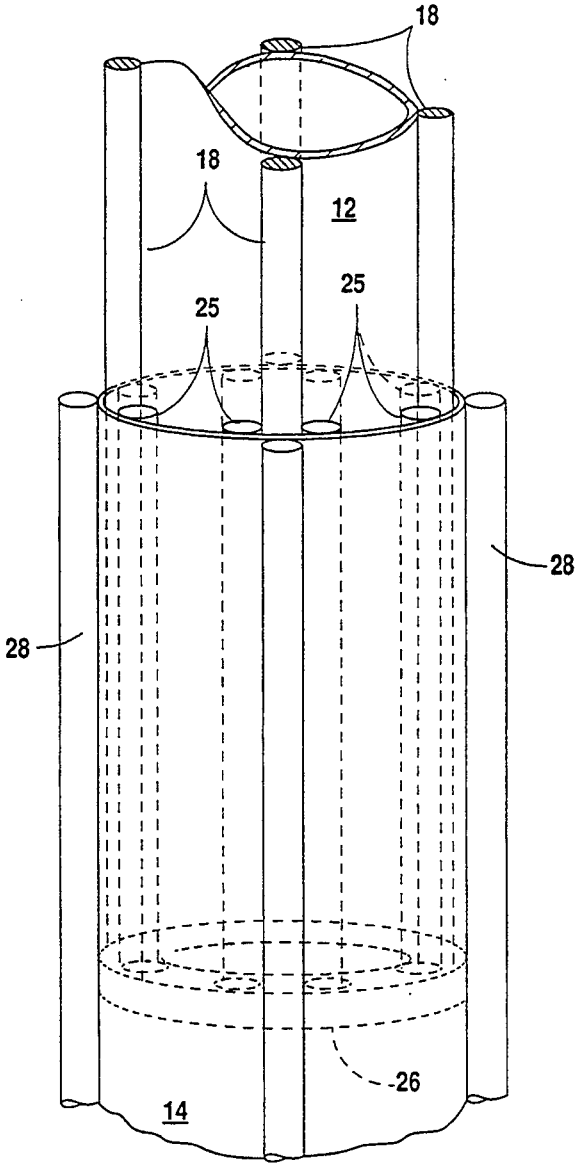
FIG. 1*b* is an enlargement of the joint between the middle and lower sections of the kelly bar.
Figure 1C:
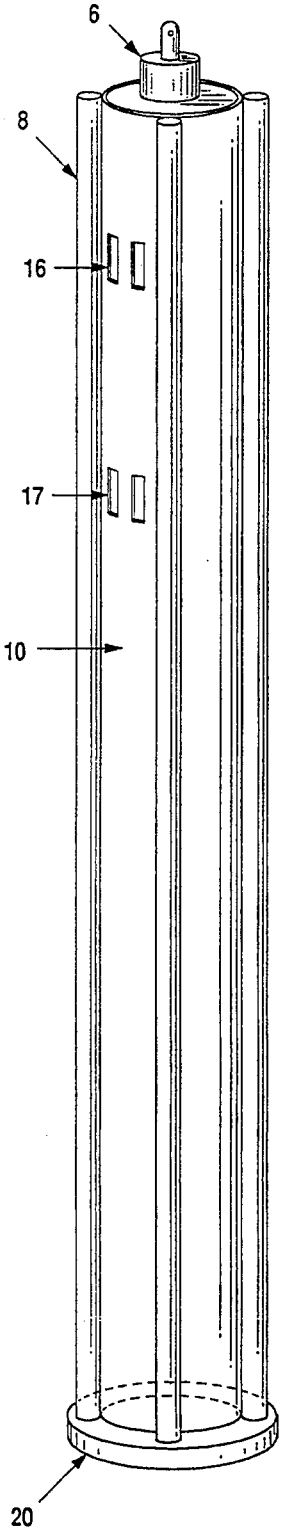
FIG. 1*c* is a perspective view of the upper inner section.
Figure 2A:
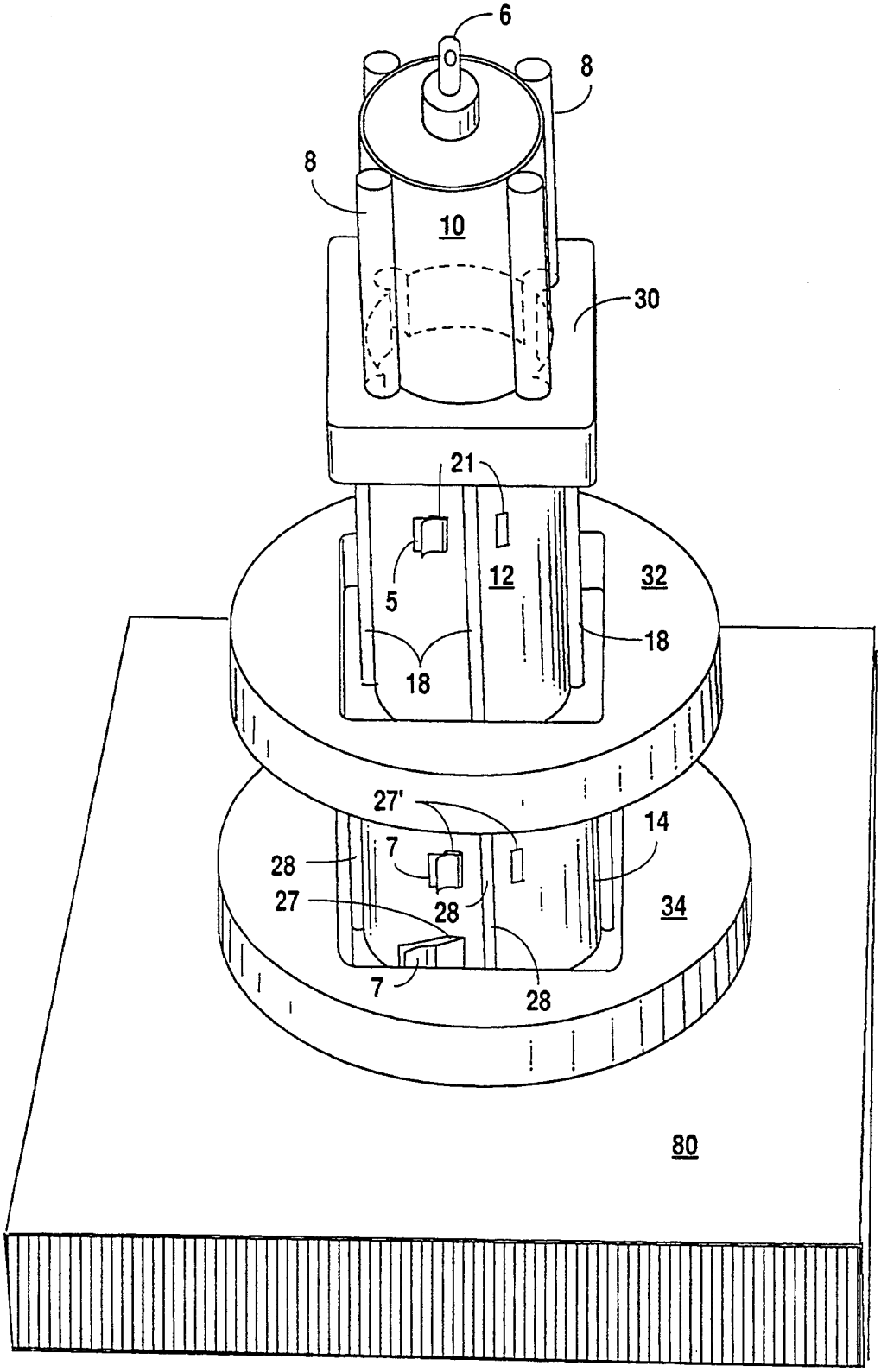
FIG. 2*a* is a perspective view of the three sections and their drivers.
Figure 4B:
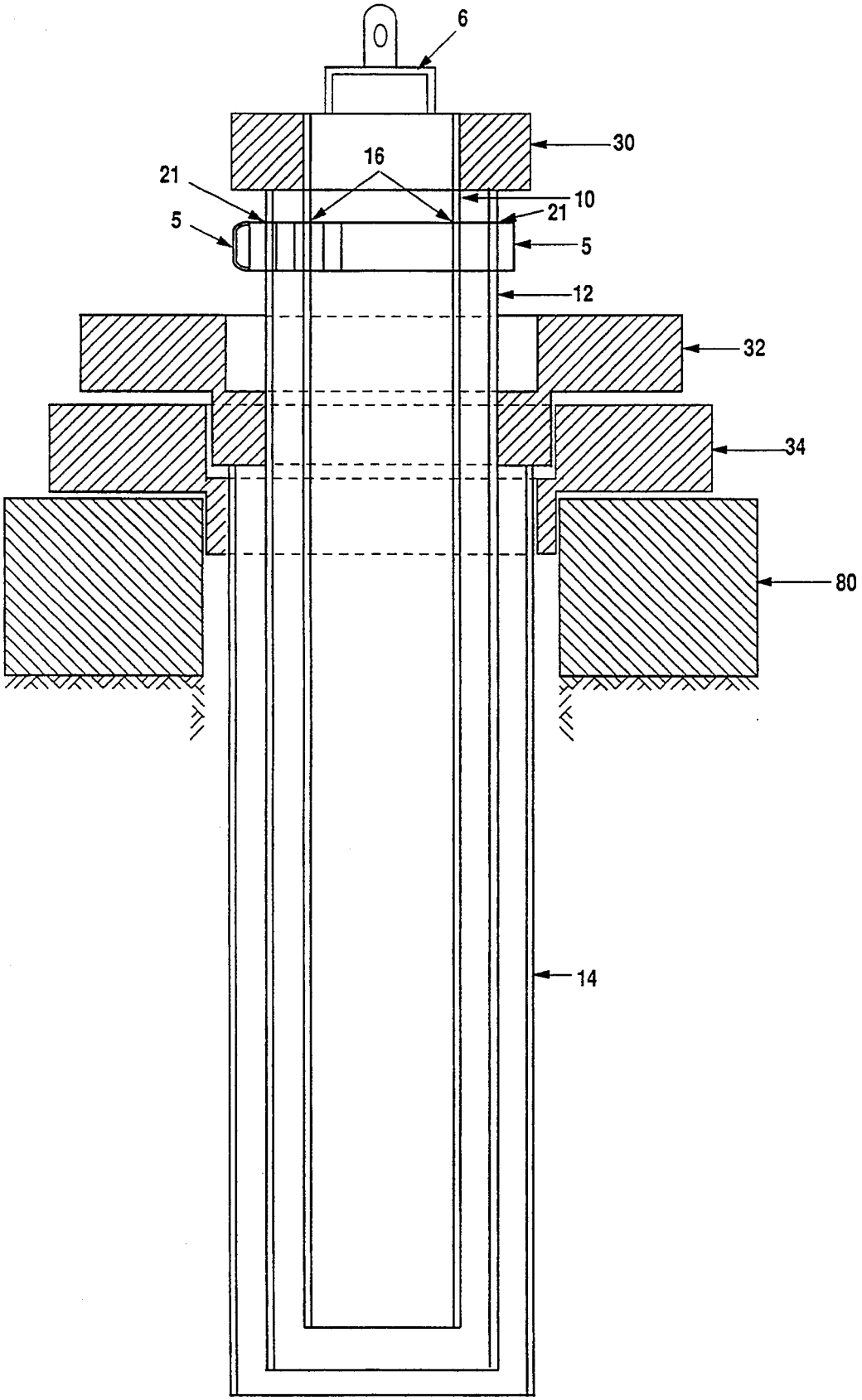
FIG. 4*b* is a cross-section view of the lower outer section of telescopic kelly bar fully extended.

FIG. 1 and FIG. 1*a* show that at one end of the upper inner section 10 ring 20 is located. The object of ring 20 is to act as a stop between middle section 12 and upper inner section 10 when both bars are fully extended. Upper inner section 10 has slot 16 and slot 17 as shown in FIG. 1*c*. Slot 16 and slot 17 are holes that are designed to let a pin go through. This pin can be any kind of heavy duty pin. Slot 16 is designed to receive a pin that will hold together middle section 12 and upper inner section 10, as shown in FIGS. 2*a*, 4*a* and 4*b*. Slot 17 is designed to receive a pin that will hold together upper inner section 10 with middle section 12 and lower outer section 14 shown in FIG. 2*a*. Generally, the number of slots that it has is the number of sections of larger diameter that the reverse telescopic kelly bar has. Upper inner section 10 also has swivel 6 that is used to lift the whole assembly.

Figure 1D:
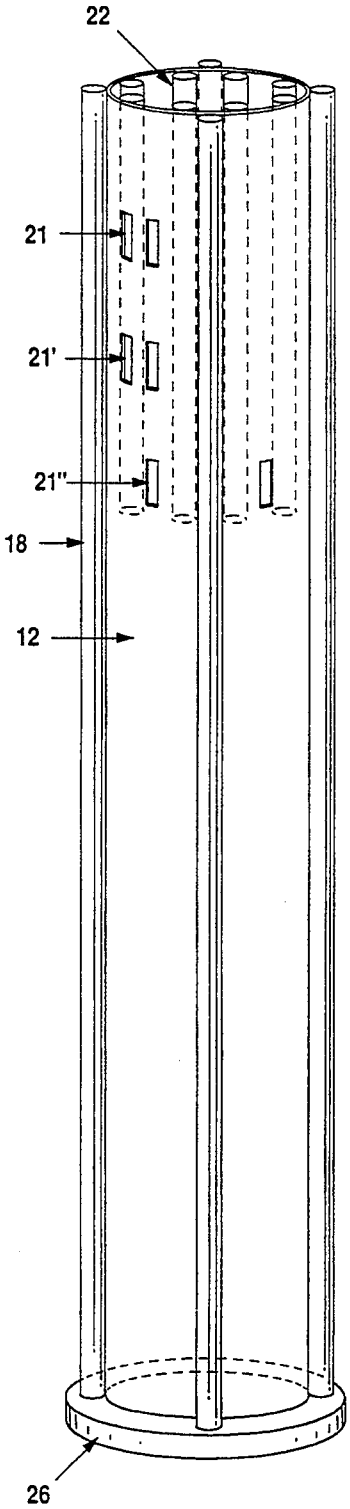
FIG. 1*d* is a perspective view of the middle section.

Middle bar or middle section 12, shown in FIG. 1*d*, has upper inner drive lugs 22, outer drive lugs 18, slots 21, 21' and 21'' and ring 26. Upper inner drive lugs have a dual function; to receive the torque transmitted by the outer drive lugs 8 of upper inner section 10, and to act as a stop with ring 20 of upper inner drive 10, as shown on FIG. 1 and FIG. 1*a*. Slots 21, 21' and 21'' are not shown in FIG. 1*a* in order to clearly define the junction between ring 20 of upper inner section 10 and upper inner lugs 22 of middle section 12. Upper inner drive lugs 22 are of a small length compared to the total length of middle section 12. Upper inner drive lugs 22 have to be long enough so they can safely act as a stop in conjunction with ring 20 of upper inner section 10 and to effectively receive torque from outer lugs 8 of upper inner section 10. Also, upper inner drive lugs 22 of middle section 12 have to be short enough in order to maximize the available length of middle section 12. However, the length of upper inner driver lugs 22 must extend below slot 21'' of middle section 12. Middle section 12 has outer lugs 18. Outer lugs 18 of middle section 12 transmit torque to the upper inner lugs 25 of lower outer section 14. An enlarged view of this is shown on FIG. 1*b*. Referring back to FIG. 1, middle section 12 has slot pairs 21, 21′ and 21″. Slots 21 and 21′ have the function of allowing a pin to go through the bars thereby holding the bars together. That is, slot 21 allows a pin to go through slot 21 of middle section 12 and slot 16 of upper inner section 10 to hold middle section 12 and upper inner section 10 together. Slot 21′ permits a pin to hold the lower outer section 14 with the middle section 12 and upper inner section 10 together as shown in FIG. 4*a*. As a general rule, the number of slots of middle section 12 will be equal to two plus the number of bars of greater diameter.

Referring back to FIG. 1 lower outer section 14 has upper inner drive lugs 25, outer drive lugs 18, slot 27 and slot 27′. Upper inner drive lugs 25 have two functions. One function is to receive torque from outer drive lugs 18 of middle section 12 and the second function is to act as a stop between middle section 12 and lower outer section 14 as shown in FIG. 1*b*. FIG. 1*b* does not show slots 27 and 27′ of lower outer section 14 in order to clearly show the junction between upper inner drive lugs 25 of lower outer section 14 and ring 29 of middle section 12. Upper inner drive lugs 25 are of a small length compared to the total length of lower outer section 14. Upper inner drive lugs 25 have to be long enough so they can safely act as a stop in conjunction with ring 26 of middle section 12, and to efficiently receive torque from outer lugs 18 of middle section 12. Also, upper inner lugs 25 of lower outer section 14 have to be short enough in order to maximize the available length of lower outer section 14. However the length of upper inner lugs 25 must extend below the slot 27 of lower outer section 14. Ring 26 is designed to engage with upper inner drive lugs 25 of lower outer section 14. Lower outer section 14 has outer lugs 28 which are used to transmit torque into the drill itself. Lower outer section 14 has slots 27 and 27′. Slot 27′ allows a pin to hold the three bars together as shown in FIG. 4*a*. A pin will go through slot 27′ of lower outer section 14, it will then go through slot 21′ of middle section 12 and it will go through slot 17 of the upper inner section 10.

Figure 1E:
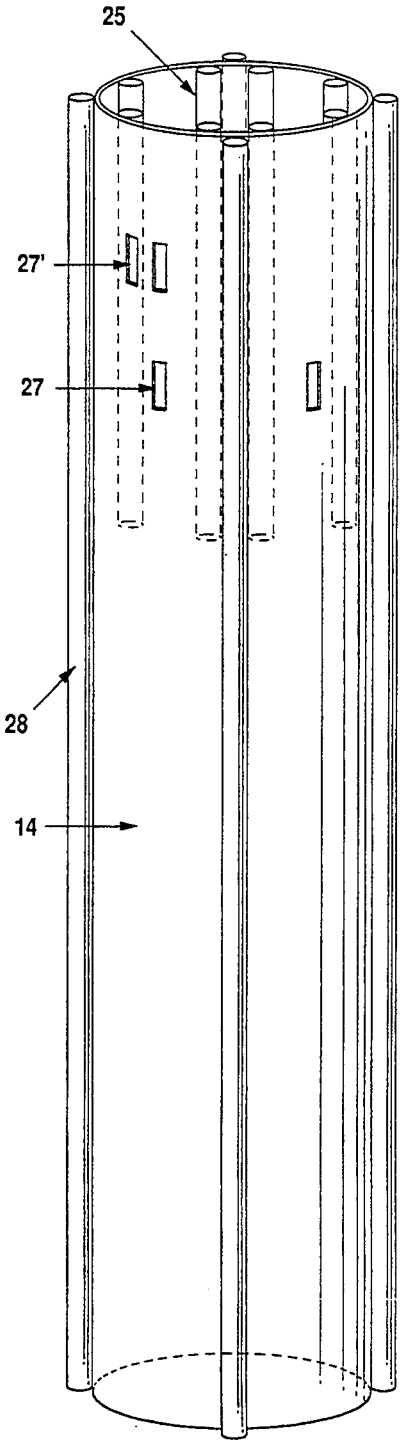
FIG. 1*e* is a perspective view of the lower outer section.

Upper inner section 10 is shown on FIG. 1*c*. Upper inner section 10 has outer lugs 8 which extend through the whole length of upper inner section 10. It has ring 20 in the bottom of the bar. On the top of the bar there is swivel 6 so the bar can be lifted. Slots 16 and 17 are located on the top of upper inner section 10. Middle section 12 is shown on FIG. 1*d*. On the upper part of middle section 12 are upper inner lugs 22 and on the bottom end ring 26 is located. Middle section 12 has outer lugs 18 and slots 21, 21′ and 21″. FIG. 1*e* shows lower outer section 14, upper inner drive lugs 25, outer drive lugs 28 and slots 27 and 27′.

FIG. 2*a* shows a perspective view of the top of the assembly of the reverse telescopic kelly bar, a part of upper inner section 10 with its upper inner driver 30, middle section 12 with its upper inner driver 32, and the top section of lower outer section 14 with its outer driver 34 and rotary 80. It specifically shows the lower outer section 14 hanging on the outer driver 34. Upper inner section 10 is of a smaller diameter than the diameter of middle section 12, which is a smaller diameter than that of lower outer section 14. Upper inner driver 30 is of a square shape and is designed to rest on top of middle section 12. Middle driver 32 is composed of two parts, the two parts are shown on FIGS. 3*b* through 3*d*. The above part is a donut 35. The bottom part is a block 36. In the upper inner portion of donut 35, there is a hole 37 that is designed to specifically engage with the upper inner driver 30. Block 36 is located under donut 35. Block 36 is designed to rest on top of the lower outer section 14, as shown on FIG. 2*a*. The outer driver 34 is a two part embodiment. Outer driver 34 is engaging with rotary 80. A better description of outer driver 34 is shown on FIG. 3*e*. FIG. 2*a* also shows slots 21 and 21′ of middle section 12 and slots 27 and 27′ of lower outer section 14. Upper inner driver 30 transmits torque to upper inner section 10, middle driver 32 transmits torque to middle section 12 and outer driver 34 transmits torque to lower outer section 14.

Figure 2B:
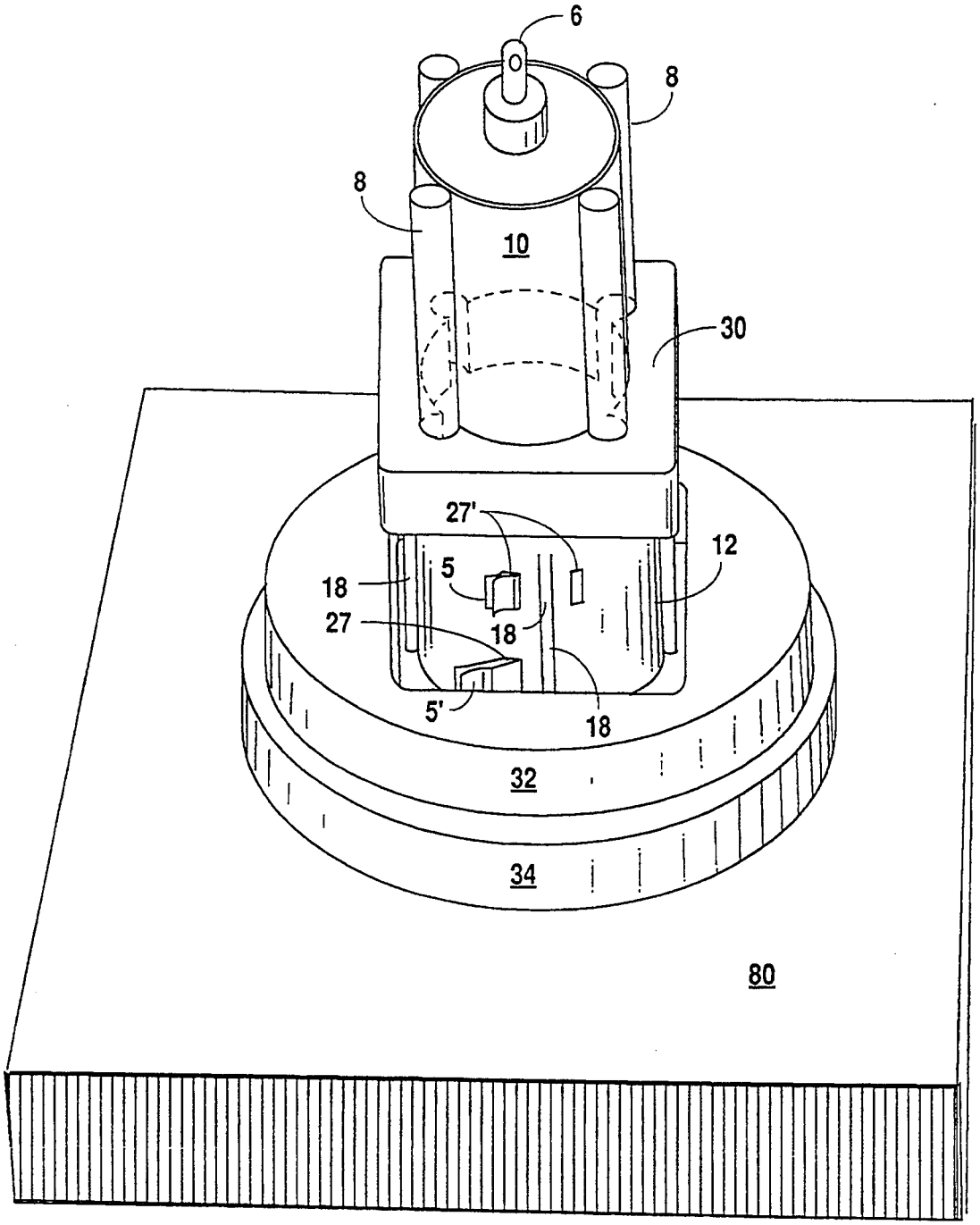
FIG. 2*b* is a perspective view of the top driver resting on the middle section, the middle driver resting on the outer lower driver, the middle section and top inner section.

FIG. 2*b* shows the whole kelly assembly when lower outer section 14 is fully extended. It shows middle driver 32 resting on top of outer driver 34, upper inner driver 30 resting on middle section 12, and upper inner section 10 inside middle section 12. A pin is inserted in slot 21 of middle section 12. The pin goes through slot 21 of middle section 12 and goes through slot 16 of upper inner section 10 as shown in FIG. 4*b*. While a pin is holding both sections together this pin is under considerable stress making it difficult to remove. In order to remove pin 5, pin 5′ needs to be inserted in slot 21″ in order to hang middle section 12 on middle driver 32. Once middle section 12 hangs on middle driver 32, the stress that pin 5 is under is relieved making it easier to remove pin 5.

Figure 3A:
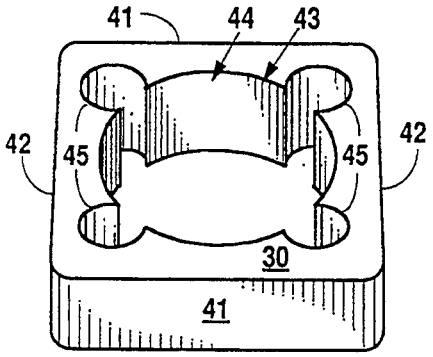
FIG. 3*a* is a perspective view of one component of the top driver.
Figure 3D:
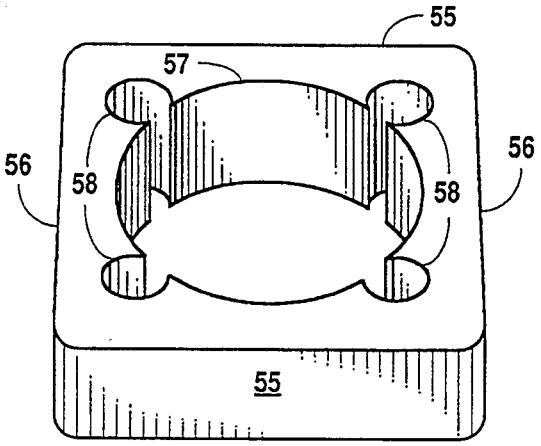
FIG. 3*d* is a perspective view of the middle driver block.

FIG. 3*a* shows a perspective view of upper inner driver 30. Upper inner driver 30 has a length 41 and width 42. In the middle of upper inner driver 30, hole 43 is located. Hole 43 is designed to engage with upper inner section 10 from FIG. 1. Hole 43 consists of circle 44 and adjacent circle 45. Circle 43 and adjacent circle 45 are designed to engage with upper inner section 10 and its outer drive lugs 18 shown on FIG. 1*a*.

Figure 3G:
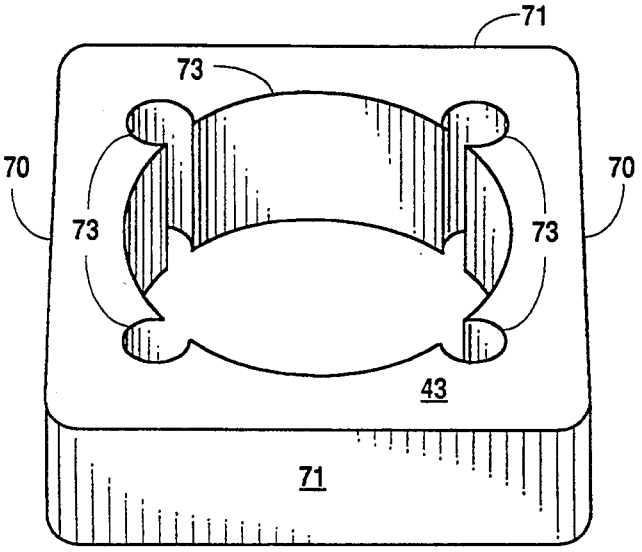
FIG. 3*g* is a perspective view of the lower outer driver block.
Figure 3B:
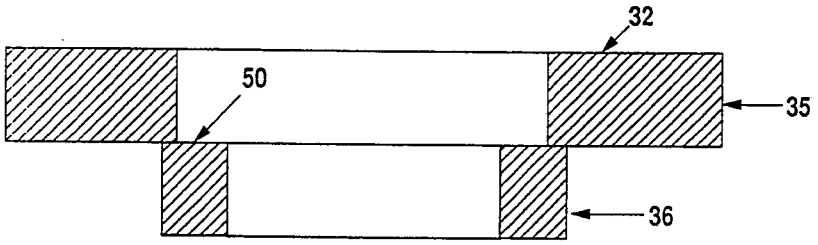
FIG. 3*b* is a cross-sectional view of the middle driver.
Figure 3C:
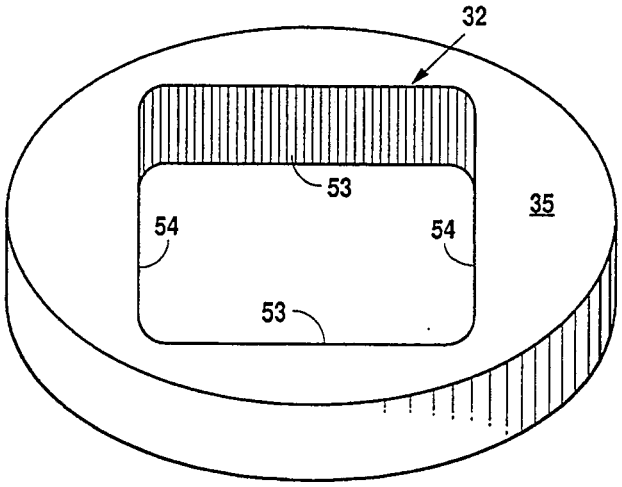
FIG. 3*c* is a perspective view of the middle driver donut.

FIG. 3*b* shows a cross-section view of the two parts which comprise middle driver 32. Donut 35 is welded at point 50 to block 36. FIG. 3*c* shows a perspective view of donut 35. Donut 35 is cylindrical with a rectangular hole 52. Rectangular hole 52 has side 53 and side 54. The side 53 of hole 52 is slightly larger than side 41 of upper inner driver 30 shown on FIG. 3*a*. The side 54 of hole 52 is slightly larger than side 41 of upper inner driver 30 as shown on FIG. 3*a*. This is so upper inner driver 30 can efficiently engage into hole 52 of donut 35. Block 36 of middle driver 32 is shown on FIG. 3*d*. Block 36 has side 55 and side 56. In the middle of block 36 is hole 57. The diameter of hole 57 is slightly larger than the diameter of middle section 12. Hole 57 has adjacent holes 58 which are designed to engage to outer drive lugs 18 of middle section 12 shown on FIG. 1*b*.

Figure 3E:
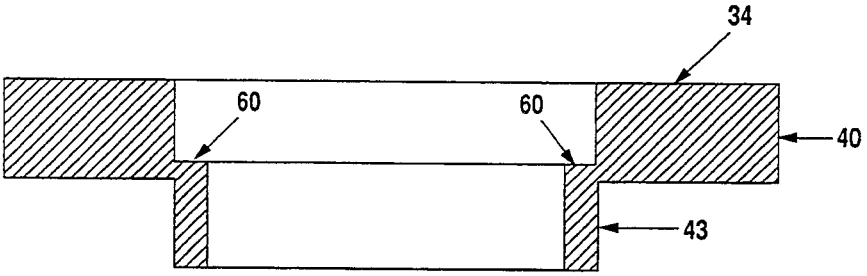
FIG. 3*e* is a cross-section view of the lower outer driver.

FIG. 3*e* shows a cross-sectional view of outer driver 34. It comprises donut 40, and block 43. Donut 40 and block 43 are welded together at point 60.

Figure 3F:
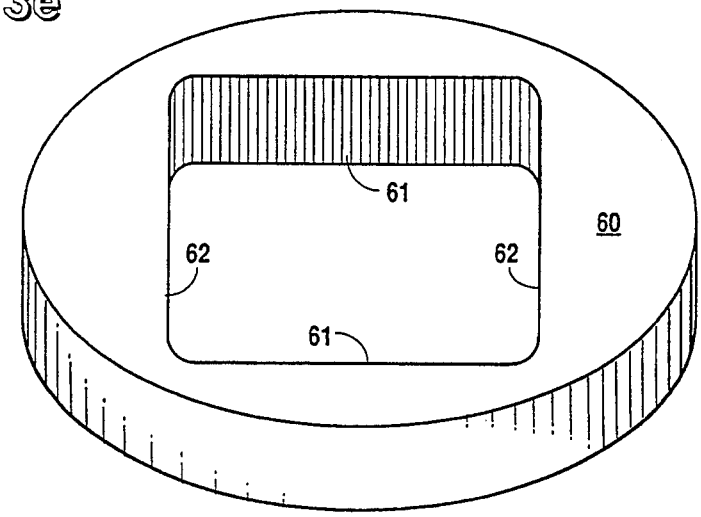
FIG. 3*f* is a perspective view of the lower outer driver donut.

FIG. 3*f* shows a perspective view of donut 40 of outer driver 34 which has a rectangular hole 42 with a side 61 and side 62. Side 61 and side 62 of rectangular hole 42 are slightly larger than side 55 and side 56 of block 36 of middle driver 32 of FIG. 3*d*. This is so block 36 of middle driver 32 can engage in rectangular hole 42 of outer driver 34. FIG. 3*g* shows a perspective view of block 43. It has side 71 and side 72. It has hole 73. The diameter of hole 73 is slightly larger than the diameter of lower outer section 14 of FIG. 1*e*. Hole 73 has adjacent hole 75 which are designed to attach to lower outer section 14 of FIG. 1*e*.

Figure 4C:
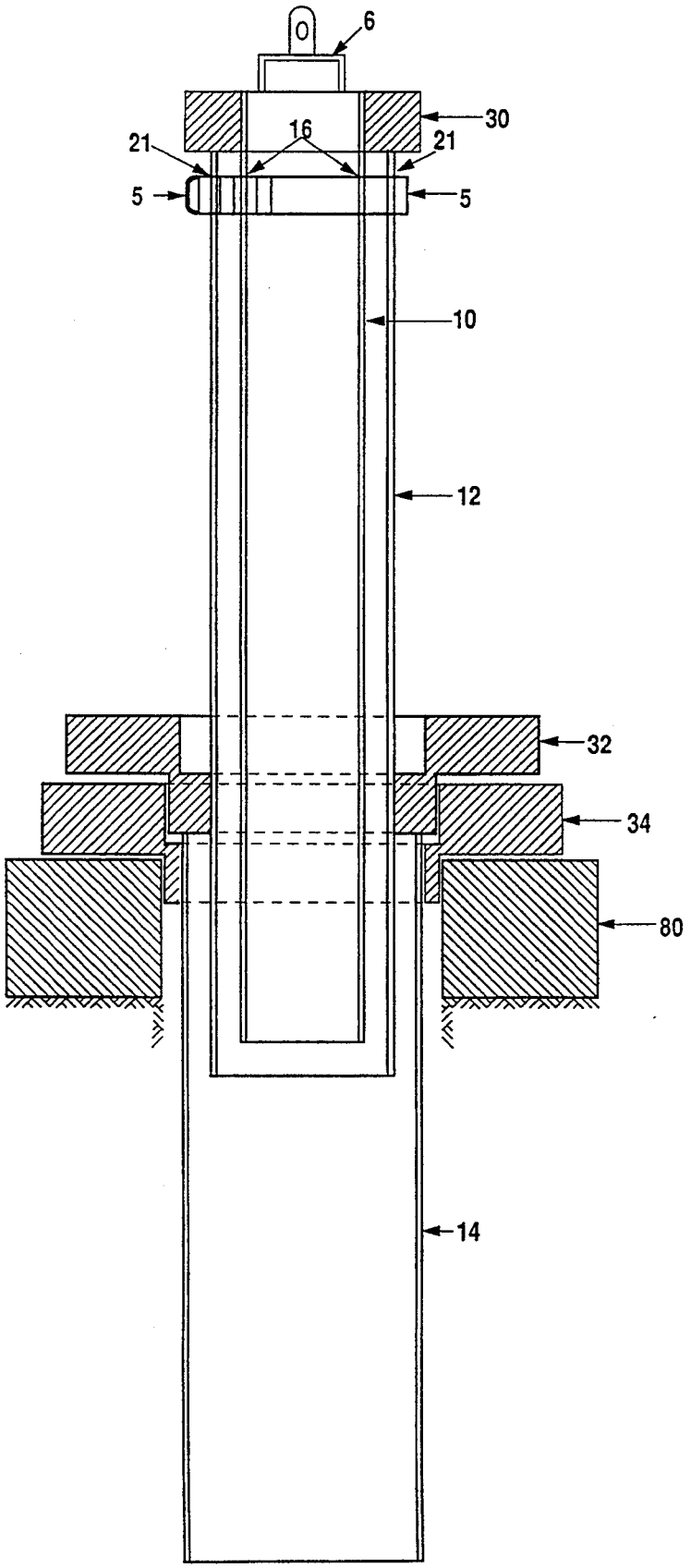
FIG. 4*c* is a cross-section view of the next step the reverse telescopic kelly bar needs to be in before it continues to drill.
Figure 4D:
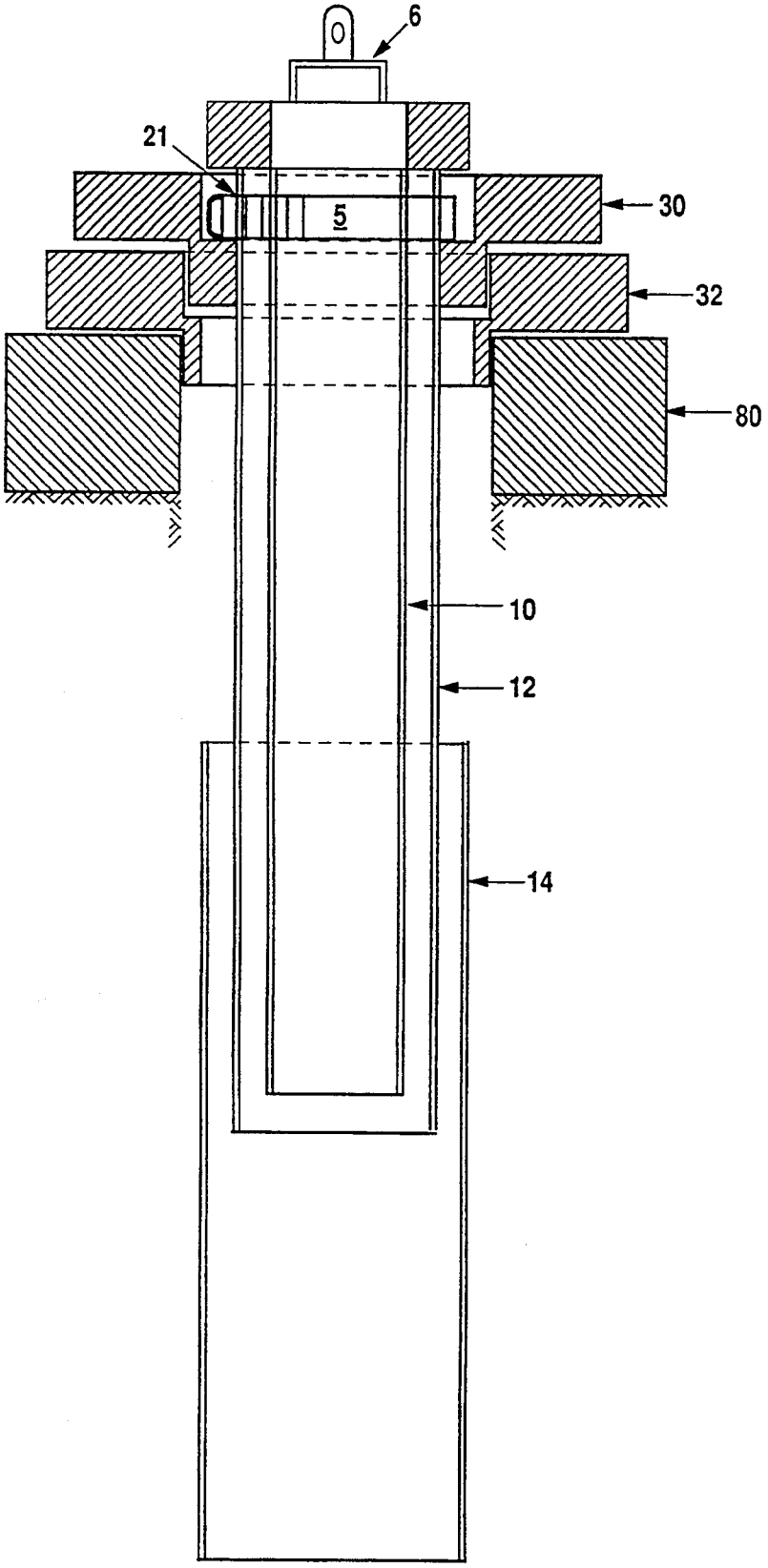
FIG. 4*d* is a cross-section view showing the lower outer and middle bar fully extended.
Figure 4E:
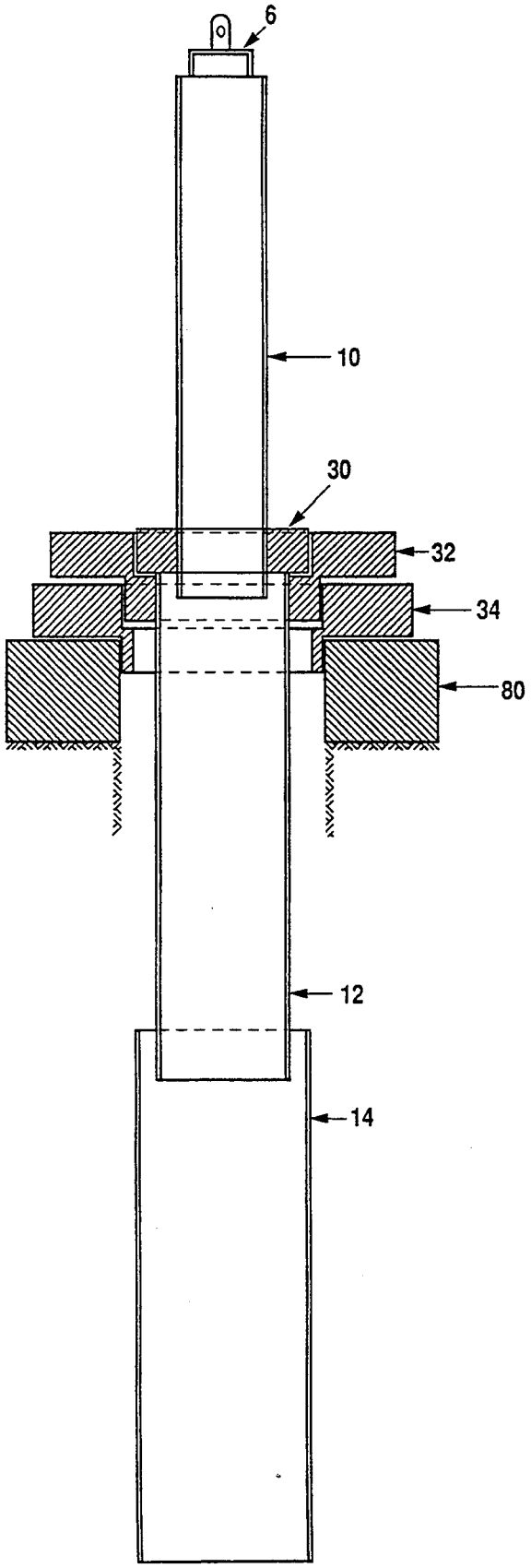
FIG. 4*e* is a cross-section of the next step to start extending the upper inner bar downward as excavation proceeds.
Figure 4F:
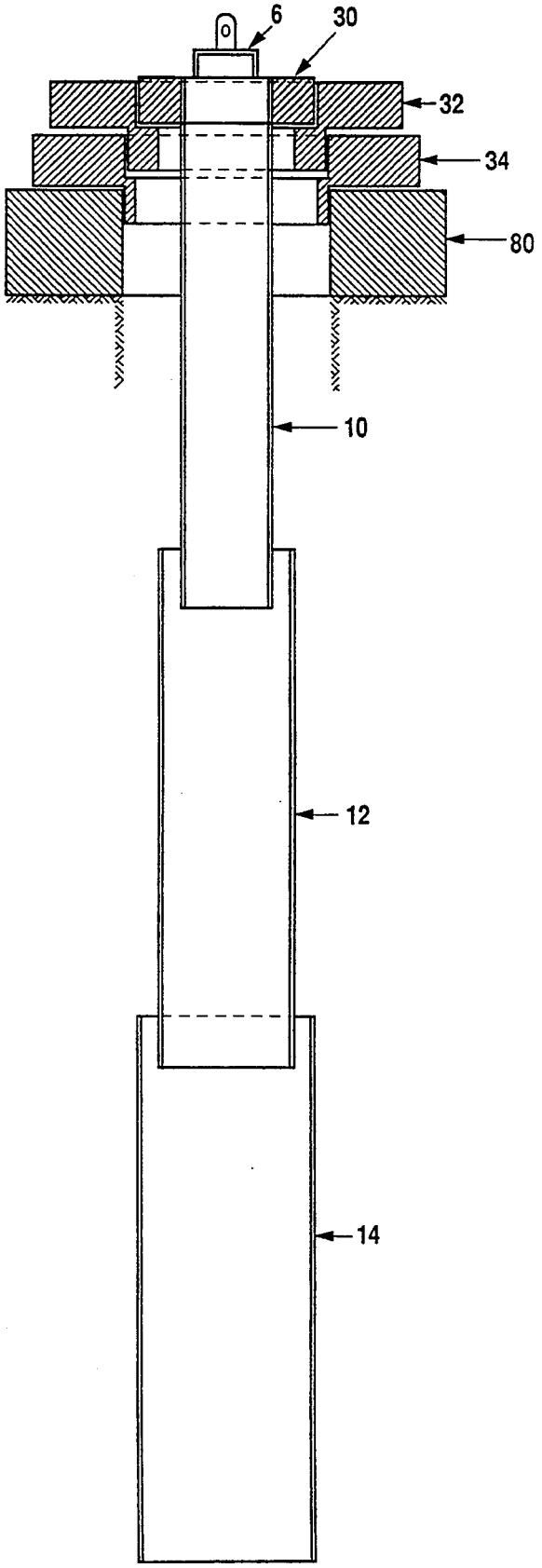
FIG. 4*f* shows all the bars fully extended.

To illustrate how the system works, a cross-section of all bars stacked together is shown on FIG. 4*a*. FIG. 4*a* shows upper inner section 10, middle section 12 within lower outer section 14. The bars are held together by pin 7 that goes through slot 27 of lower outer section 14, slot 21' of middle section 12 and slot 17 of upper inner section 10. Another pin 5 holds together middle section 12 and upper inner section 10. Pin 5 goes through slot 21' of middle section 12 and slot 16 of upper inner section 10. Upper inner driver 30 of upper inner section 10 rests on top of middle section 12. Middle driver 32 rests on top of lower outer section 14. Outer driver 34 of the lower outer section 14 rests inside rotary 80. Rotary 80 has direct engagement with outer driver 34. Rotary 80 transmits torque to the outer driver 34 which then transmits the torque to lower outer section 14. The three drivers rotate and turn the reverse telescopic kelly bar. Once the lower outer section 14 is drilled out or fully extended downwardly, as shown on FIG. 4*b*, the process to release pin 7 which holds all three bars together begins. The first step is to hang lower outer section 14 as shown on FIG. 2*a*. This consists of inserting a pin 7' in slot 27 of lower outer section bar 14. After pin 7' has been inserted in slot 27, lower outer section 14 is then let to hang on outer driver 34. At this point, pin 7 is removed. Once pin 7 is removed, lower outer section 14 is released from middle section 12 and upper inner section 10. In order to drill deeper, the middle and upper inner bars or sections are lifted up as shown on FIG. 4*c* and pin 7' is then removed. Pin 5 goes through slot 21 of middle section 12 and slot 16 of upper inner section 10, holding the two bars together. Middle driver 32 then applies a rotating force to middle section 12 which in turn passes the rotating force to lower outer section bar 14. The drilling will continue, until the point middle section 12 cannot go any lower, as shown on FIG. 4*d*. In order to continue with the excavation, it is necessary to lift upper inner section 10 as shown in FIG. 4*e*. This is done by lifting middle section 12 so that pin 5' can be inserted in slot 21'' of middle section 12 as shown in FIG. 2*b*. Once pin 5° is inserted in slot 21'' of middle section 12, middle section 12 can hang on middle driver 32, as shown on FIG. 2*b*. When middle section 12 hangs on middle driver 32 the stress of pin 5 is released. At this point, pin 5 is retrieved. Upper inner section 10 is lifted as shown on FIG. 4*e*. Outer driver 34 then applies rotating force to middle driver 32, and middle driver 32 transmits the rotating force to upper inner driver 30. At this point, the rotating force that is passed to upper inner driver 30 is transmitted to upper inner section 10. The rotating force is transmitted from upper inner driver 30 to upper inner section 10, which then transmits rotation to middle section 12. Middle section 12 transmits rotation to lower outer section 14. The drilling will continue until the desired depth is accomplished or upper inner section 10 is unable to go any lower, as shown in FIG. 4*f*.

The foregoing is the preferred embodiment of the invention. However, various changes can be made in this system without departing from the scope of the invention. These changes can be the use of different cross-sectional bars other than those shown. This cross-section could be square or of other shaped cross-sections. These other cross-sections will not require drive lugs to transmit torque. The preferred embodiment should not be interpreted as limiting the scope of the invention.

What is claimed:

1. A vertically telescoping multi-section kelly bar apparatus comprising:

(a) an upper inner bar section for suspending from a cable means;

(b) at least one lower middle bar section of larger size telescopically and slidably connected over the upper inner bar section;

(c) an outer lower bar section of larger size telescopically and slidably connected over the preceding lower middle bar section;

(d) said upper inner bar section, at least one lower middle bar section and outer lower bar sections each having a bar driver slidably mounted thereon for transmitting rotation from a rotary table to each of the bar sections.

2. The apparatus of claim 1, wherein:

(a) the upper inner bar section has a stop to limit downward telescoping of said lower middle bar section;

(b) the connected middle bar section has inside lugs on one side and a stop on the opposite side whereby the stop of the upper inner bar holds the next size middle bar when they hang extended, the lugs and stops of the middle bars are to stop within each other when a larger diameter middle bar is hanging extended over a smaller diameter bar, and the stop of the larger diameter middle bar is to attach to the upper inner lug of the outer bar.

3. The apparatus of claim 1 wherein the bar sections are cylindrical.

4. The apparatus of claim 1 wherein comprising:

(a) a plurality of longitudinally extending drive lugs on the outside of each bar section to transmit rotation to each adjacent and lower larger bar section;

(b) a set of outside drive lugs to limit downward extending of the kelly bar sections and transmit rotation from preceding and smaller bar sections; and (c) a ring at the lower end of the bar sections and located at the lower end of each set of outside drive lugs whereby said ring stops the downward extension of each following bar section.

5. A method of drilling using a vertically telescoping multi-section kelly bar apparatus comprising:

(a) suspending an upper inner bar section from a cable means;

(b) suspending at least one lower middle bar seciton of larger size telescopically and slidably connected over the upper inner bar section;

(c) suspending an outer lower bar section of larger size telescopically and slidably connected over the preceding lower middle bar section; and (d) limiting downward extension of said at least one lower middle bar section and outer lower bar section with a slidably mounted ring at the lower end of each preceding bar section, whereby said ring contacts a set of inside drive lugs when said at least one lower middle bar section and outer lower bar section are fully extended.

* * * * *